US005615799A

United States Patent [19]

Palazzo

[11] Patent Number: 5,615,799

[45] Date of Patent: Apr. 1, 1997

[54] DISAPPEARING LIFTING LUG ASSEMBLY

[76] Inventor: David T. Palazzo, P.O. Box 290676, Tampa, Fla. 33687

[21] Appl. No.: 584,467

[22] Filed: Jan. 11, 1996

[51] Int. Cl.[6] ..... B65D 25/22

[52] U.S. Cl. ..... 220/751; 294/93; 220/768; 220/1.5

[58] Field of Search ..... 220/751, 752, 220/754, 757, 768, 770, 694, 629, 628, 1.5; 294/90, 93

[56] References Cited

U.S. PATENT DOCUMENTS

| | | | |
|---|---|---|---|
| 478,103 | 7/1892 | Hahn et al. | 220/770 |
| 852,285 | 4/1907 | Murray | 294/90 |
| 1,477,709 | 12/1923 | Lebus | 294/90 |
| 1,623,409 | 4/1927 | Hempen et al. | 220/757 |
| 2,584,124 | 2/1952 | Gustafson | 294/93 |
| 2,937,879 | 5/1960 | Lion | 220/1.5 |
| 3,143,372 | 8/1964 | Teague | 220/1.5 |
| 3,251,623 | 5/1966 | Fredholm | 294/93 |
| 3,385,011 | 5/1968 | Sorrell | 294/90 |
| 3,583,753 | 6/1971 | McCrory | 294/90 |
| 3,734,308 | 5/1973 | Pasternack | 220/1.5 |
| 4,036,424 | 7/1977 | Thang | 294/93 |
| 5,306,062 | 4/1994 | Dodge | 294/93 |

FOREIGN PATENT DOCUMENTS

| | | | |
|---|---|---|---|
| 645628 | 10/1928 | France | 220/751 |
| 4209001 | 9/1993 | Germany | 220/751 |
| 1541133 | 2/1990 | U.S.S.R. | 220/751 |

*Primary Examiner*—Stephen J. Castellano
*Attorney, Agent, or Firm*—C. Douglas McDonald, Jr. & Associates, P.A.

[57] ABSTRACT

A lifting lug is disclosed for securing a hoist to a tank, in which that lifting lug is stored within the tank but may be moved to a position extending through an opening in the sidewall of the tank for attachment to a hoist to provide for lifting of the tank, with subsequent removal back to a stored position inside the tank.

11 Claims, 3 Drawing Sheets

DISAPPEARING LIFTING LUG ASSEMBLY

FIELD OF THE INVENTION

This invention relates to a lifting lug assembly for use with liquid storage tanks.

BACKGROUND OF THE INVENTION

Tanks for storing liquids are well known and have been constructed for many years. These tanks can be constructed in a variety of ways and from a variety of materials, but are most often constructed at a different location than their intended location of use. For this and other reasons relating to safer transportation, lugs, by which the tank can be carried, are often incorporated into a liquid storage tank's construction.

Lugs that are known to the art require construction that promotes corrosion at the interface between the tank and the lug, whether that interface is a weld or a bolted connection. In addition, existing lug designs present obstacles to movement of liquid storage tanks because they extend beyond the wall of the tank.

The disappearing lug of the present invention is equally applicable to single- or double-walled liquid storage tanks. A convenient method of building a double-walled tank is disclosed in U.S. Pat. No. 4,640,439 and subsequent patents relating thereto, namely U.S. Pat. Nos. 4,644,627; 4,655,367; 4,744,137; 4,780,946; 4,780,947; 4,817,817; and 4,927,050, which are hereby incorporated by reference.

SUMMARY OF THE INVENTION

In view of the foregoing it is the object of the present invention to provide an economical apparatus for securing a hoist to a tank, which apparatus disappears into the tank when not in use. To achieve these and other objects that will become readily apparent to those skilled in the art, this invention provides a lifting lug assembly mounted to a storage tank for securing a hoist to that tank, which tank has a sidewall facing upwardly with an inner surface, an outer surface, and an opening through the sidewall. The lifting lug, including a lug member, has a portion for attaching the lug member to the inner surface of the sidewall and a portion for engaging the hoist, the lifting lug also including means for anchoring the lug member to the inner surface of the sidewall and for permitting selective movement of the lug member between a position in which the hoist engaging portion extends through the sidewall opening for use and a position in which the lug member is disposed entirely within the interior of the tank for storage.

BRIEF DESCRIPTION OF THE DRAWINGS

Particularly preferred embodiments of the apparatus of this invention will be described in detail below in connection with the drawings in which.

DESCRIPTION OF PREFERRED EMBODIMENT

Figure 1:
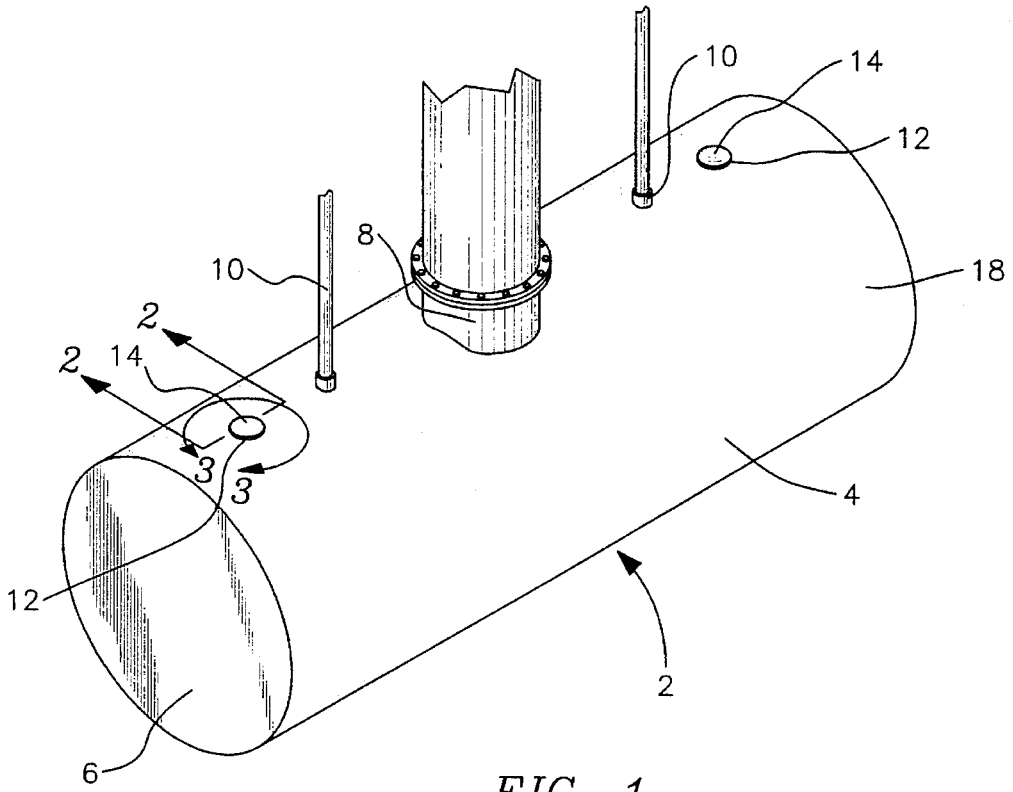
FIG. 1 is a perspective view of a tank installed with lifting lugs according to the present invention.

Preferred embodiments of the apparatus of this invention are illustrated in FIGS. 1 through 5. FIG. 1 illustrates a perspective view of a liquid storage tank incorporating the present invention. This tank, generally indicated as 2, comprises a sidewall 4 that may suitably be cylindrical, end walls 6, one or more manways 8 and fittings 10 passing through the sidewall 4.

For the purposes of the present invention, one or more openings 12 may be formed through the sidewall 4. When not in use, the openings 12 may be sealed using caps 14. Although the tank 2 is depicted as a single wall liquid storage tank, this invention is equally suitable to other tanks for storage of gases, livestock, and for other uses. Likewise, this invention is equally as suitable for double-walled tanks and other constructions and shapes of tanks as it is to the cylindrical single wall tank depicted in FIG. 1.

Figure 2:
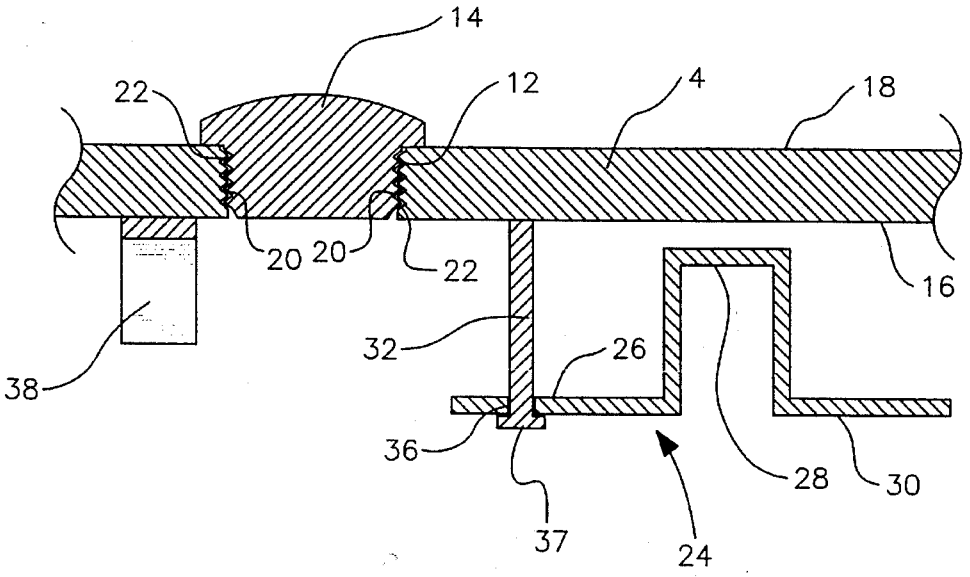
FIG. 2 is a fragmentary side sectional view of the tank of FIG. 1, taken along line 2—2, depicting a cap closing the sidewall opening.

FIG. 2 is a fragmentary side sectional view of the tank 2 of FIG. 1 taken along line 2—2, depicting a cap 14 closing the sidewall opening 12. The sidewall 4 depicted in FIG. 2 is generally upwardly facing and has an inner surface 16 and an outer surface 18. Referring to the opening 12, a convenient method of retaining cap 14 in opening 12 is by providing external threads 20 on the cylindrical surface of the cap 14 and internal, mating threads 22 along that part of the opening 12 that engages the cap 14. Although threads 20 and 22 are a convenient method of retaining the cap 14 securely in the opening 12, any other such method known to the art, including bolts, a latch, friction fitting, and other suitable means, may conveniently be used for the present invention.

The lug member, generally indicated as 24, comprises securing portions 26 and 30 for engagement with the inner surface 16 of the sidewall 4 as well as a hoist engaging portion 28. In a preferred embodiment, lug member 24 is formed of a strong material, such as steel. The hoist engaging portion 28 is connected at its ends to the securing portions 26 and 30 of the lug member 24. Although lug member 24 may suitably be formed from a bar or rod of steel, other well-known materials capable of being formed to the desired configuration and possessing the necessary strength, would also be suitable for the present invention.

The hoist engaging portion 28 may be an inverted U-shaped portion of the lug member 24 as depicted in FIG. 2. In this preferred embodiment, the U-shaped hoist engaging portion 28 is the only part of the lug member 24 that extends through the opening 12 in the sidewall, when lug member 24 is in a position of use, as shown in FIGS. 3 and 4.

Figure 3:
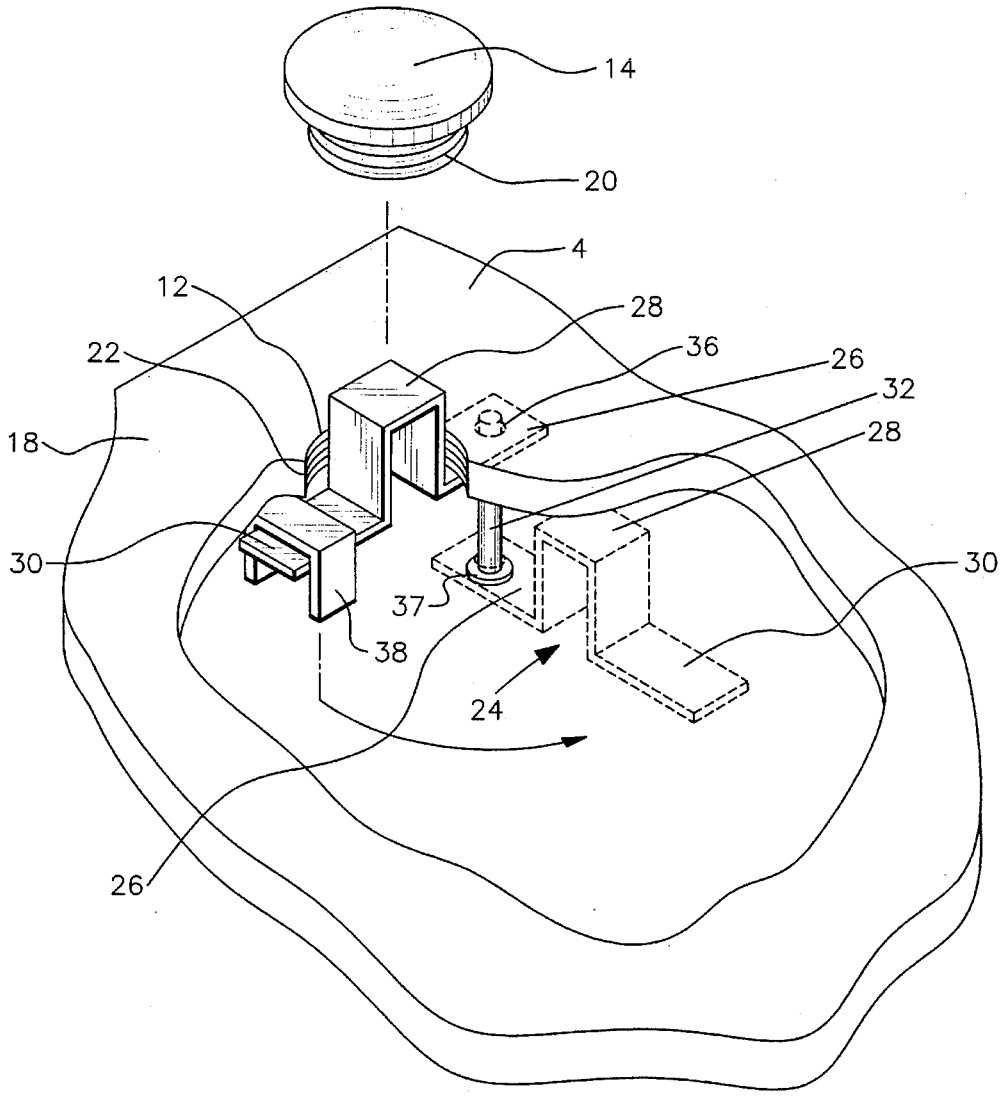
FIG. 3 is a fragmentary side cutaway perspective view taken along line 3—3 of FIG. 1 of the lifting lug according to the present invention in a position of use.
Figure 4:
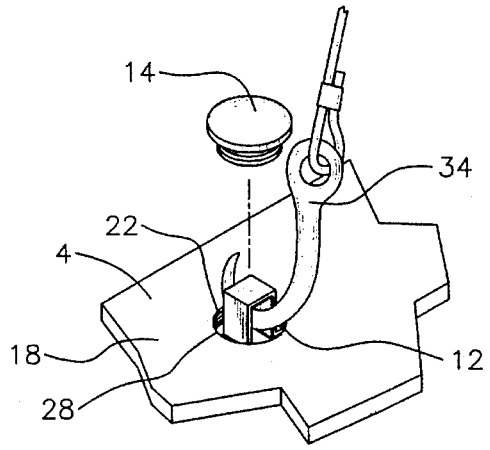
FIG. 4 is a fragmentary perspective view of the lifting lug of FIG. 3 engaging a hoist.

As seen in FIG. 3, a fragmentary side cutaway perspective view taken along line 3—3 of FIG. 1, the lug member 24 is anchored by securing portions 26 and 30 to the sidewall 4 of the tank 2 by means 32 for anchoring the lug member 24 to the inner surface 16 of the sidewall 4 of the tank 2. This structure provides for selective movement of the lug member 24 between a position in which the lug member 24 is disposed entirely within the tank sidewall 4 for storage, as depicted in FIG. 2 and the phantom representation of FIG. 3, and a position in which the hoist engaging portion 28 extends through the sidewall opening 12 for use, as depicted in the solid line representation of FIG. 3 and in FIG. 4, a fragmentary perspective view of the lifting lug of FIG. 3 shown engaging hoist 34. In this embodiment anchoring means 32 may conveniently comprise a shaft extending inwardly of the sidewall inner surface 16 through an aperture, or journal 36, of lug member 24 for positioning the lug member with respect to the sidewall opening 12. This shaft 32 may be provided with an enlarged head 37 to restrain movement of the lug member thereupon. This arrangement may provide for both sliding movement of the lug member 24 longitudinally along the shaft 32 and for rotation of the member 24 about the shaft 32. Thus, the lug member 24 may be rotated about the shaft 32 to position the hoist engaging portion 28 adjacent the sidewall opening 12 and then may be moved along the shaft 32 in a direction outwardly of the tank sidewall 4 to expose the hoist engaging portion 28 of the lug member 24 through the opening 12 for engagement with the hoist 34. The lug member 24 may also be moved inwardly of the tank sidewall 4 when engagement with the hoist 34 is not desired, with the enlarged head 37 maintaining at least one portion 26 of the lug member being maintained proximal the sidewall opening 12.

In this preferred embodiment journal means 36 may comprise an opening formed through the securing portion 26 of the lug member 24. It is equally suitable to the purposes of the present invention to replace journal means 36 with other means for permitting travel of the lug member 24 along and around the shaft 32, including a ball-bearing collar, a sleeve about the shaft, a rail and hinge arrangement, and other means known to the art for allowing the lug member 24 to travel between a position of use and a position of retraction.

As depicted in FIG. 3 in a fragmentary cutaway perspective, lug member 24, when in its position of use, engages positioning means 38 to limit rotation about shaft 32 of the lug member 24 during attachment to a hoist 34 and thus contribute to anchoring the lug member 24 to the inner surface of the sidewall of the tank. A convenient embodiment of positioning means 38 is a U-shaped member mounted to the tank sidewall inner surface 16 with its open side facing downward. In this position the means 38 for positioning the lug member 24 against rotation when the lug member 24 is in a position of use engages locking portion 30 and prevents rotational travel of lug member 24 about the shaft 32. Other means for locking the lug member 24 known to the art are also suitable to the present invention, including engaging the locking portion 30 with a bolt, dimensioning the opening 12 to prevent travel of the hoist engaging portion 28 in a rotational fashion about the shaft 32, and separately attaching two sides of the locking means 38 without a middle portion to achieve the locking purpose of locking means 38.

Figure 5:
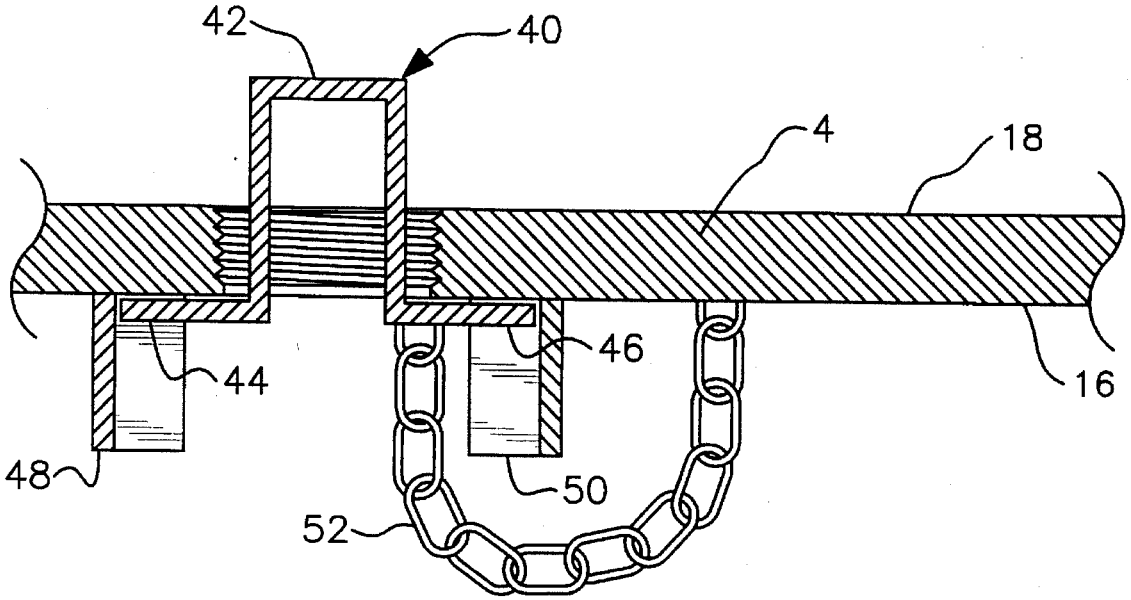
FIG. 5 is a fragmentary side sectional view similar to FIG. 2 but illustrating an alternative embodiment of the lifting lug in its lifting position.

An alternative embodiment of the lifting lug of this invention is illustrated in the fragmentary side view of FIG. 5. This view, which corresponds generally to the sectional view of FIG. 2, illustrates an alternative form of the lifting lug, designated by the reference number 40, in the hoist engaging position, similar to that illustrated in the solid line representation of FIG. 3. This lifting lug 40 engages the inner surface 16 of the tank sidewall 4 in the same manner as the previous embodiment, with the hoist engaging portion 42 projecting through the opening in the sidewall and the securing portions 44 and 46 engaging the inner surface 16 of that tank sidewall. However, neither of those securing portion 44 and 46 are journaled to any shaft but, instead, are received within respective three-sided, box-like positioning means 48 and 50 to hold that lifting lug 40 in position without substantial rotation or other movement when in that first position with the hoist engaging portion 42 extending through the sidewall. Attached to the lifting lug 40 is an appropriate restraining means 52, which comprises a flexible element of predetermined length, such as a chain or cable, the opposite end of which is attached to the tank sidewall 4. In this manner, when the lifting lug is moved to its second position, disposed entirely within the tank for storage, that lifting lug 40 will hang proximal the sidewall opening by the restraining means 52 when the lug member is disposed entirely within the tank and may easily be retrieved and brought through the sidewall opening for use in lifting.

Throughout this description, attachment of any one part to any other, such as attachment of positioning means 38 to the inner surface 16 of the sidewall 4, may conveniently be achieved by any chemical or mechanical bond known to the art including, for example, use of bolts, adhesives, rivets, and welding. Although FIGS. 1–4 depict the tank 2 and lug member 24 in a vertical orientation, this invention can be practiced with equal efficiency if the tank 2 is in any other orientation, for example, to provide attachment points for tie-down cables during shipment.

While the foregoing describes in detail a preferred embodiment of the lifting lug of this invention, it is to be understood that such description is illustrative only of the principles of the invention and is not to be considered limitative thereof. Because numerous variations and modifications of the lifting lug will readily occur to those skilled in the art, the scope of this invention is to be limited solely by the claims appended hereto.

What is claimed is:

1. A combination of a storage tank and a lifting lug for securing a hoist to said tank, said tank comprising a generally upwardly facing sidewall having an inner surface facing the interior of said tank and an outer surface and an opening formed through said sidewall, said lifting lug comprising a lug member comprising a securing portion attached to said inner surface of said sidewall and a hoist engaging portion for engaging said hoist; and said lug member being anchored to said inner surface of said sidewall of said tank and permitting selective movement of said lug member between a first position in which said hoist engaging portion extends through said sidewall opening for use and a second position in which said lug member is disposed entirely within the interior of said tank for storage.

2. The combination of claim 1 wherein said lug member hoist engaging portion is disposed between a first part of said securing portion and a second part of said securing portion.

3. The combination of claim 1 wherein said hoist engaging portion comprises a U-shaped portion of said lug member disposed between a first part of said securing portion and a second part of said securing portion.

4. The combination of claim 1 wherein said lug member is anchored to said inner surface of said sidewall by positioning means for maintaining the position of said lug member within said tank with said hoist engaging portion extending through said sidewall when said lug is in said first position, and restraining means attached to said tank and engaging said lug member for maintaining at least one portion of said lug member generally proximal said sidewall opening when said lug member is in said second position, and said lug member is connected to said restraining means for movement of said lug member between said first position and said second position, and said lug member securing portion is configured to engage said positioning means when said lifting lug is moved to said first position.

5. The combination of claim 4 wherein said positioning means is attached to said tank sidewall inner surface.

6. The combination of claim 4 wherein said restraining means is attached to said tank sidewall inner surface.

7. The combination of claim 4 wherein said restraining means comprises elongated guide means extending inwardly of said tank sidewall inner surface, and said lug member further comprises at least one portion engaging said guide means for sliding movement of said lug member longitudinally of said guide means between said first position and said second position.

8. The combination of claim 7 wherein said positioning means comprises a generally U-shaped member affixed to said tank sidewall inner surface and positioned to engage a portion of said lug member distal said portion engaging said guide means.

9. The combination of claim 4 wherein said restraining means comprises a flexible element of predetermined length attached to said tank inner wall and to said lug member.

10. The combination of claim 9 wherein said positioning means comprises elements extending inwardly of said tank inner surface on opposite sides of said sidewall opening for receiving said lug member securing portions therebetween, whereby movement of the lug member is restrained when the lug member is in the first position.

11. The combination of claim 1 further comprising a cap generally corresponding to the shape of said sidewall opening for engaging said opening, whereby the sidewall opening may be closed when the lug member is in its second position for storage.

* * * * *